US006621058B1

(12) United States Patent
Kim

(10) Patent No.: US 6,621,058 B1
(45) Date of Patent: Sep. 16, 2003

(54) WALL-MOUNTED MICROWAVE OVEN WITH AIR CURTAIN GUIDE

(75) Inventor: Gong-Soo Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/207,820

(22) Filed: Jul. 31, 2002

(30) Foreign Application Priority Data

May 23, 2002 (KR) ..... 2002-28759

(51) Int. Cl.[7] ..... H05B 6/80

(52) U.S. Cl. ..... 219/757; 219/756; 126/21 A; 126/299 R

(58) Field of Search ..... 219/757, 756, 219/702, 681; 126/21 A, 299 R, 299 D

(56) References Cited

U.S. PATENT DOCUMENTS 4,184,945 A * 1/1980 Morgan et al. ..... 219/757
4,346,692 A * 8/1982 McCauley ..... 126/299 D
6,072,169 A * 6/2000 Kang et al. ..... 219/757

FOREIGN PATENT DOCUMENTS

JP 60-42515 * 3/1985 ..... 219/757
JP 63-251740 * 10/1988 ..... 126/299 D
JP 1-302684 * 12/1989 ..... 219/757
JP 6-180135 * 6/1994 ..... 126/299 D
JP 2001-004151 1/2001

* cited by examiner

*Primary Examiner*—Philip H. Leung
(74) *Attorney, Agent, or Firm*—Staas & Halsey LLP

(57) ABSTRACT

A wall-mounted microwave oven outputs an air curtain which guides gas and fumes generated from an oven located therebelow to the outside. The wall-mounted microwave oven includes an oven body which is mountable on a wall, a cooking chamber and an electric component compartment which are isolated from each other by a partition plate, an exhaust flow path arranged in the oven body to exhaust the gas and fumes generated from the oven, an exhaust fan which exhausts the gas and fumes introduced into the exhaust flow path to the outside, an air-discharging outlet which is provided at a front and lower portion of the wall-mounted microwave oven and forms the air curtain, and a blower fan which is disposed in the oven body and provides air to the air-discharging outlet. The air curtain guides the gas and fumes toward the exhaust flow path of the wall-mounted microwave oven so as to effectively exhaust the gas and fumes to the outside.

25 Claims, 6 Drawing Sheets

WALL-MOUNTED MICROWAVE OVEN WITH AIR CURTAIN GUIDE

CROSS-REFERENCE TO RELATED APPLICATIONS

This application claims the benefit of Korean Patent Application No. 2002-28759 filed on May 23, 2002, in the Korean Industrial Property Office, the disclosure of which is incorporated herein by reference.

BACKGROUND OF THE INVENTION

1. Field of the Invention

The present invention relates to a microwave oven, and more particularly, to a wall-mounted microwave oven which provides an air curtain to guide exhaust gas and fumes rising from a gas oven disposed below the wall-mounted microwave oven.

2. Description of the Related Art

Generally, a wall-mounted microwave oven is installed on a wall above, for example, a gas oven. The wall-mounted microwave oven not only carries out a cooking operation, but also exhausts gas and fumes generated from the gas oven disposed below the wall-mounted microwave oven.

FIG. 1 shows a conventional wall-mounted microwave oven comprising a body 1, a cooking chamber (not shown), which accommodates food therein, and an electric component compartment 5, which accommodates various electric components, that are isolated from each other. An exhaust flow path 3 is provided around the cooking chamber and the electric component compartment 5. The exhaust flow path 3 is adapted to exhaust gas and fumes generated from a gas oven 2 located below the body 1 of the wall-mounted microwave oven. The body 1 is provided at its rear and upper side with an exhaust fan 4 to exhaust the gas and fumes introduced through the exhaust flow path 3 to the outside.

An exhausting operation of the wall-mounted microwave oven is carried out so as to have the gas and fumes generated from the gas oven 2 directed into an intake port 3*a* provided under the body 1, sucked through the exhaust flow path 3, and discharged to the outside.

However, the wall-mounted microwave oven has a width "W1," from a front end to a rear end, which is smaller than a corresponding width "W2" of the gas oven 2. Therefore, it is difficult to obtain a sufficient exhausting effect to exhaust the gas and fumes rising from the gas oven 2 even though the exhaust fan 4 is used.

Typically, the intake port 3*a* of the exhaust flow path 3 is located above a rear burning section 2*b* of the gas oven 2. Accordingly, although gas and fumes generated from the rear burning section 2*b* can be sufficiently sucked into the intake port 3*a* of the exhaust flow path 3, gas and fumes generated from a front burning section 2*a* of the gas oven 2 are not wholly sucked into the intake port 2*a*. Rather, a significant portion of the gas and fumes generated from the front burning section 2*a* rise vertically and upwardly, and contaminate a kitchen space.

SUMMARY OF THE INVENTION

Accordingly, it is an object of the present invention to provide a wall-mounted microwave oven which emits an air curtain that guides gas and fumes generated from a gas oven toward its intake port to efficiently exhaust the gas and fumes.

Additional objects and advantages of the invention will be set forth in part in the description which follows and, in part, will be obvious from the description, or may be learned by practice of the invention.

To achieve the above and other objects of the present invention, there is provided a wall-mounted microwave oven mountable on a wall above a range-oven, comprising a partition plate, an oven body which is mountable on the wall and includes a cooking chamber and an electric component compartment which are isolated from each other by the partition plate, an exhaust flow path disposed in the oven body to exhaust gas and fumes generated from the range-oven, an exhaust fan which exhausts the gas and fumes introduced into the exhaust flow path to the outside, an air-discharging outlet which is provided at a front and lower portion of the oven body, and forms an air curtain that guides the gas and fumes generated from the range-oven toward the exhaust flow path, and a blower fan which is disposed in the oven body and blows air to the air-discharging outlet.

The blower fan may be disposed in the electric component compartment so as to direct the air to the air-discharging outlet while cooling an inside of the electric component compartment.

The air-discharging outlet may laterally extend at a front and lower side of the oven body, and a bottom plate of the oven body may be provided at its front side with an air guide duct which forms a flow path to guide the air from the electric component compartment toward the air-discharging outlet.

The oven body may be provided at an upper portion of its front face with an air inlet, through which the air is introduced into the electric component compartment by activation of the blower fan.

The electric component compartment may include an air guide plate which divides a front space of the electric component compartment, adjacent to the air inlet, into upper and lower subspaces so as to circulate the air introduced through the air inlet in the inside of the electric component compartment and guide the air to the air-discharging outlet. The blower fan may be disposed in the upper subspace above the air guide plate.

The partition plate which defines a boundary between the cooking chamber and the electric component compartment may be formed with one or more vent holes, so as to allow the air being circulated in the electric component compartment to be partially introduced into the cooking chamber therethrough.

The air-discharging outlet may include an outlet guide which extends forwardly and downwardly by a certain length, and guides the air discharged from the air-discharging outlet forward and downward.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
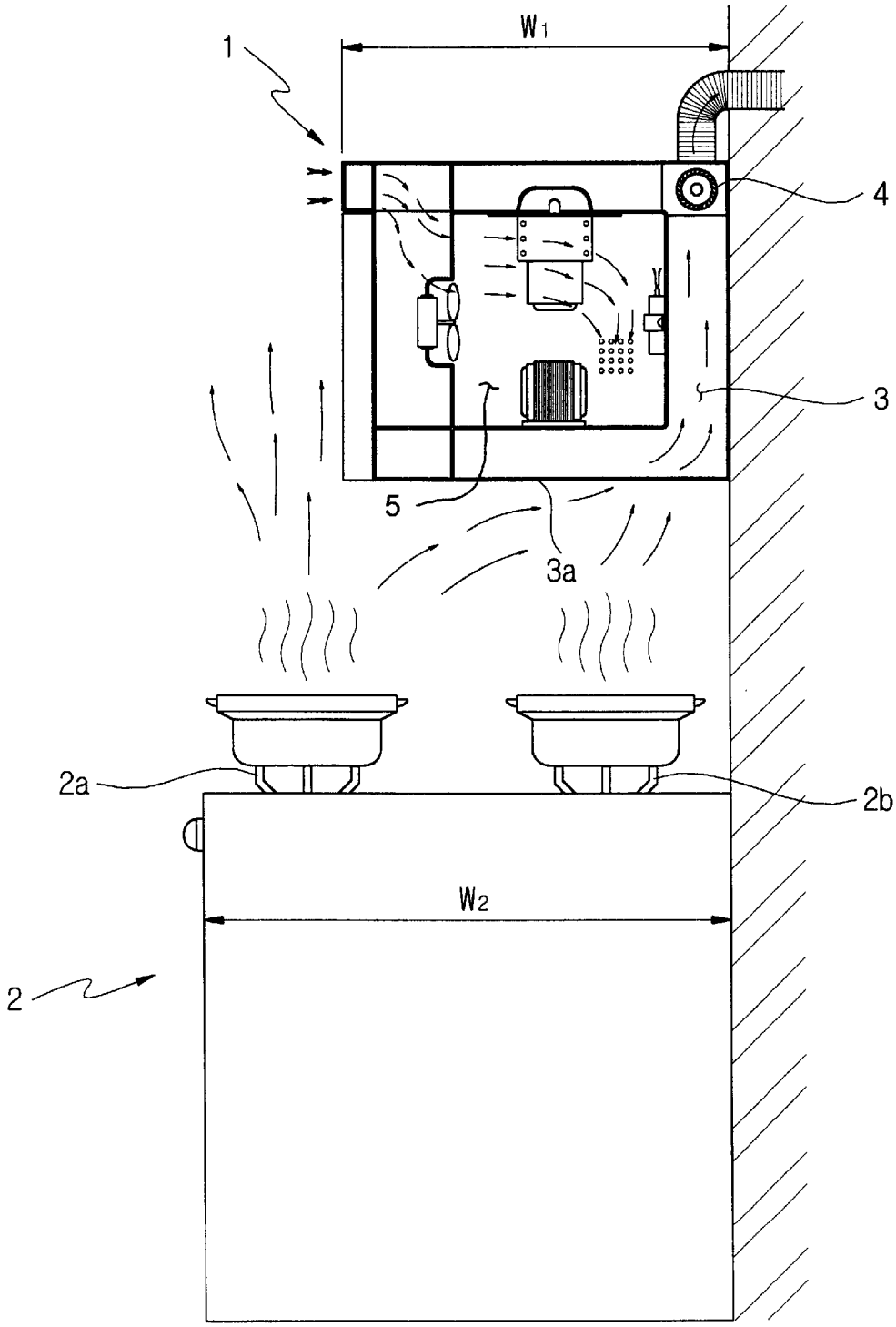
FIG. 1 (Prior Art)
FIG. 1 is a side cross-sectional view of a conventional wall-mounted microwave oven, which is mounted on a wall above a gas oven.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
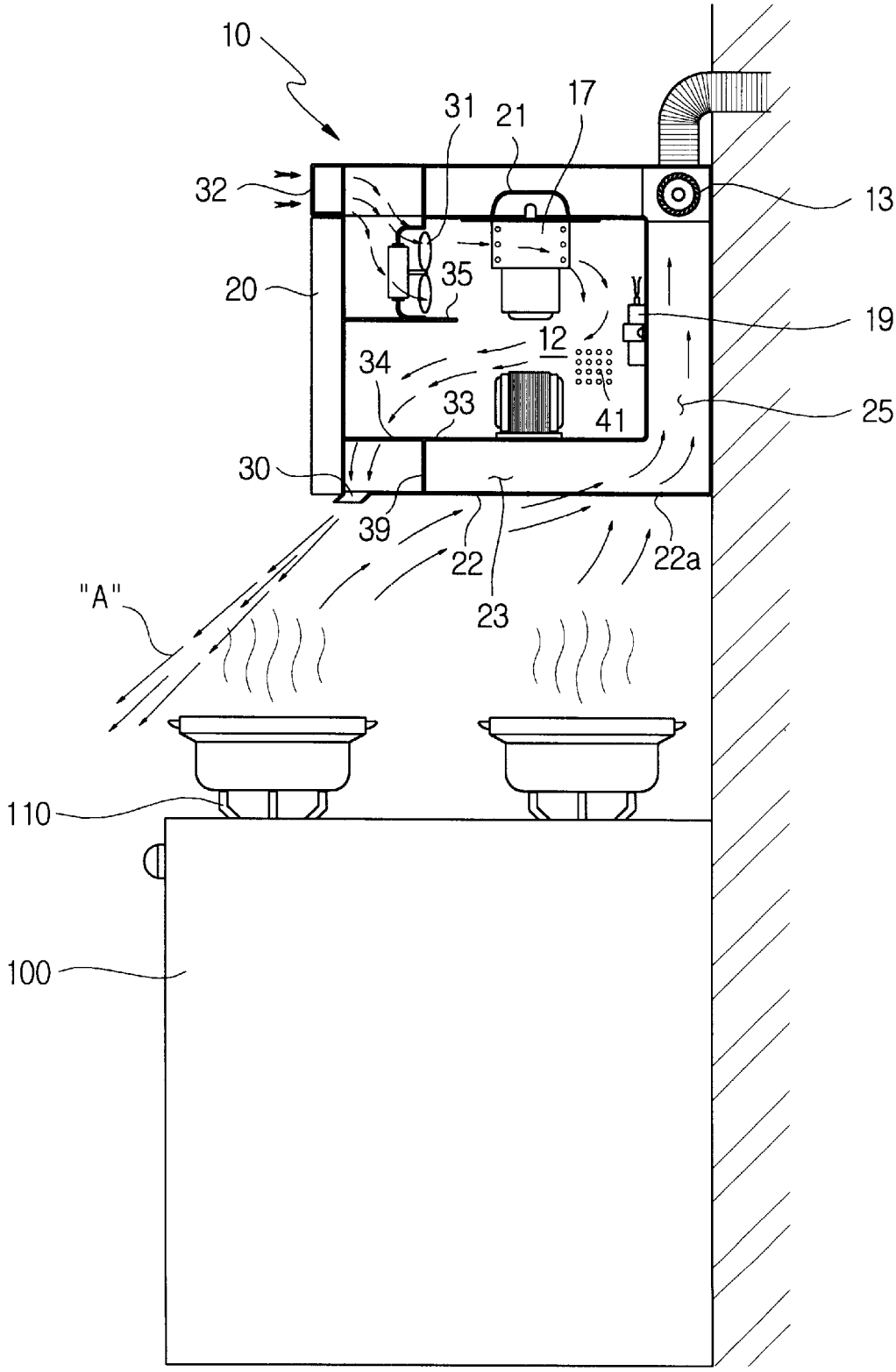
FIG. 2 is a side cross-sectional view illustrating an operation of a wall-mounted microwave oven according to an embodiment of the present invention.

FIGS. 2–5 show a wall-mounted/wall-mountable microwave oven according to an embodiment of the present invention. As shown in FIG. 2, the wall-mounted microwave oven includes an oven body 10 which is, for example, mounted on a wall of a kitchen above a gas oven 100. The oven body 10 includes a cooking chamber 11 (see FIG. 3) to cook food therein, an electric component compartment 12 which accommodates various electric components of the wall-mounted microwave oven, and an exhaust flow path, described herein below, disposed at a bottom thereof, both sides and at a top thereof to exhaust gas and fumes generated from the gas oven 100 disposed below the oven body 10. An exhaust fan 13 is provided at a rear and upper side of the oven body 10, and discharges the gas and fumes introduced through the exhaust flow path to the outside.

Figure 3:
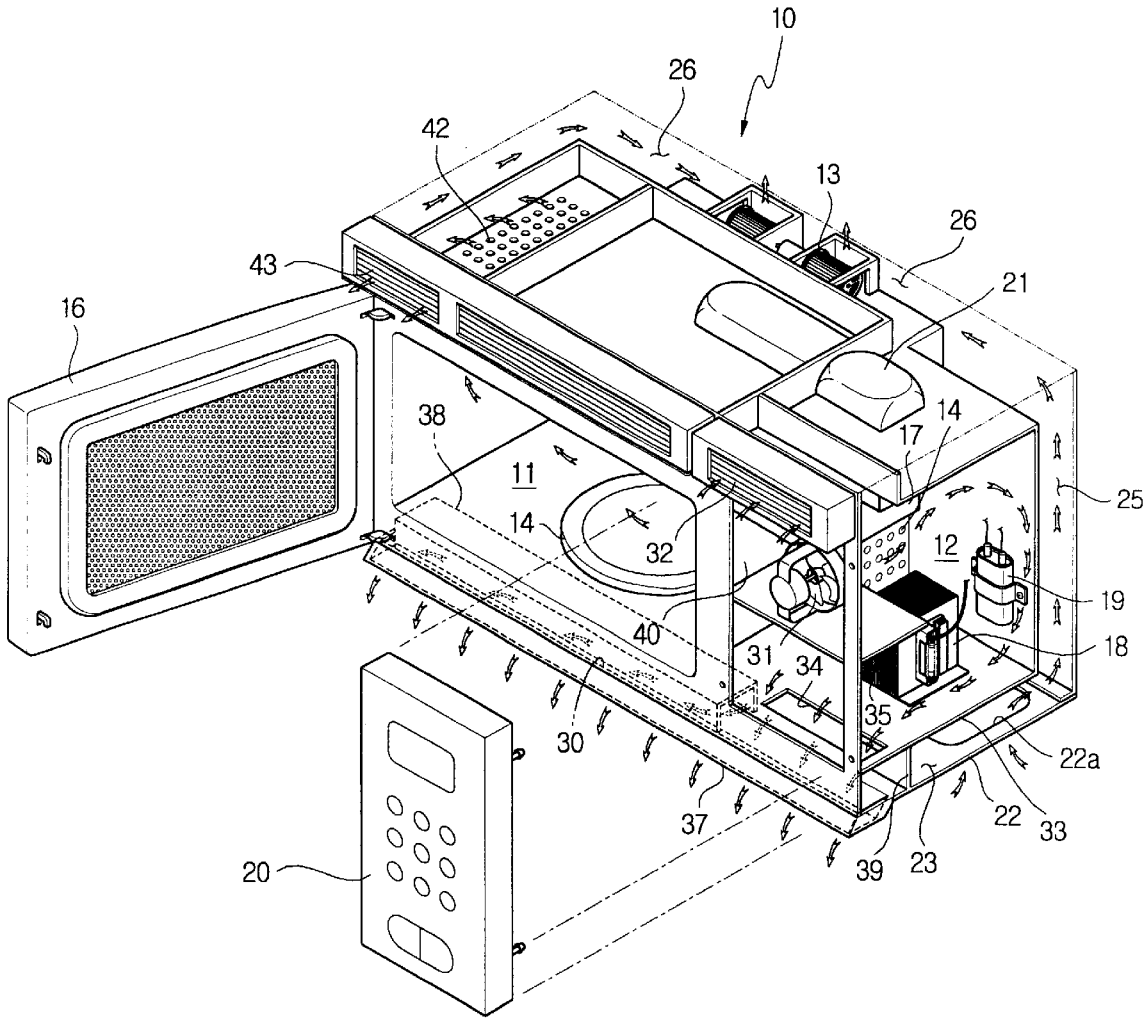
FIG. 3 is a perspective view showing the structure of the wall-mounted microwave oven shown in FIG. 2.
Figure 4:
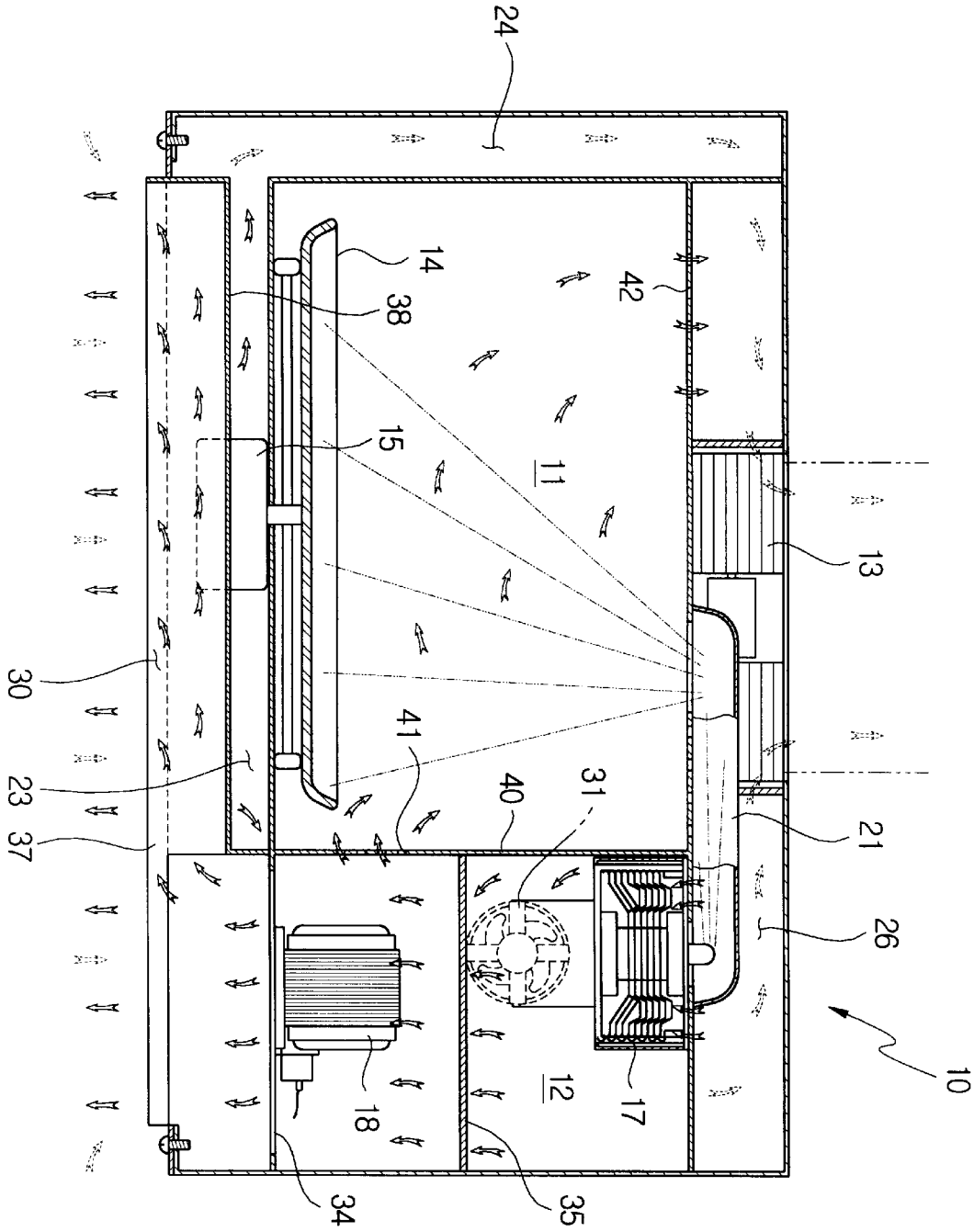
FIG. 4 is a front cross-sectional view of the wall-mounted microwave oven shown in FIG. 3.

As shown collectively in FIGS. 3 and 4, the cooking chamber 11 is provided with a turntable 14 to place food to be cooked thereon. A driving motor 15 is installed on a bottom surface of the cooking chamber 11 and rotates the turntable 14. A door 16 is provided at a front of the cooking chamber 11 and allows a user to place and remove the food into and from the cooking chamber 11.

The electric component compartment 12 includes a magnetron 17 which generates electromagnetic waves of high frequency into the cooking chamber 11, a high-voltage transformer 18 which applies a high voltage to the magnetron 17, and a high-voltage condenser 19. A control plane 20 is provided on a front surface of the electric component compartment 12. The control panel 20 includes a plurality of buttons which control various functions of the wall-mounted microwave oven. The magnetron 17 is mounted on a ceiling surface of the electric component compartment 12. The high-voltage transformer 18 is mounted on a bottom surface of the electric component compartment 12, while the high-voltage condenser 19 is attached to a rear surface of the electric component compartment 12. A waveguide 21 is disposed on the electric component compartment 12 and the cooking chamber 11. The waveguide 21 is connected to the magnetron 17 and guides the electromagnetic waves generated from the magnetron 17 into the cooking chamber 11.

Figure 5:
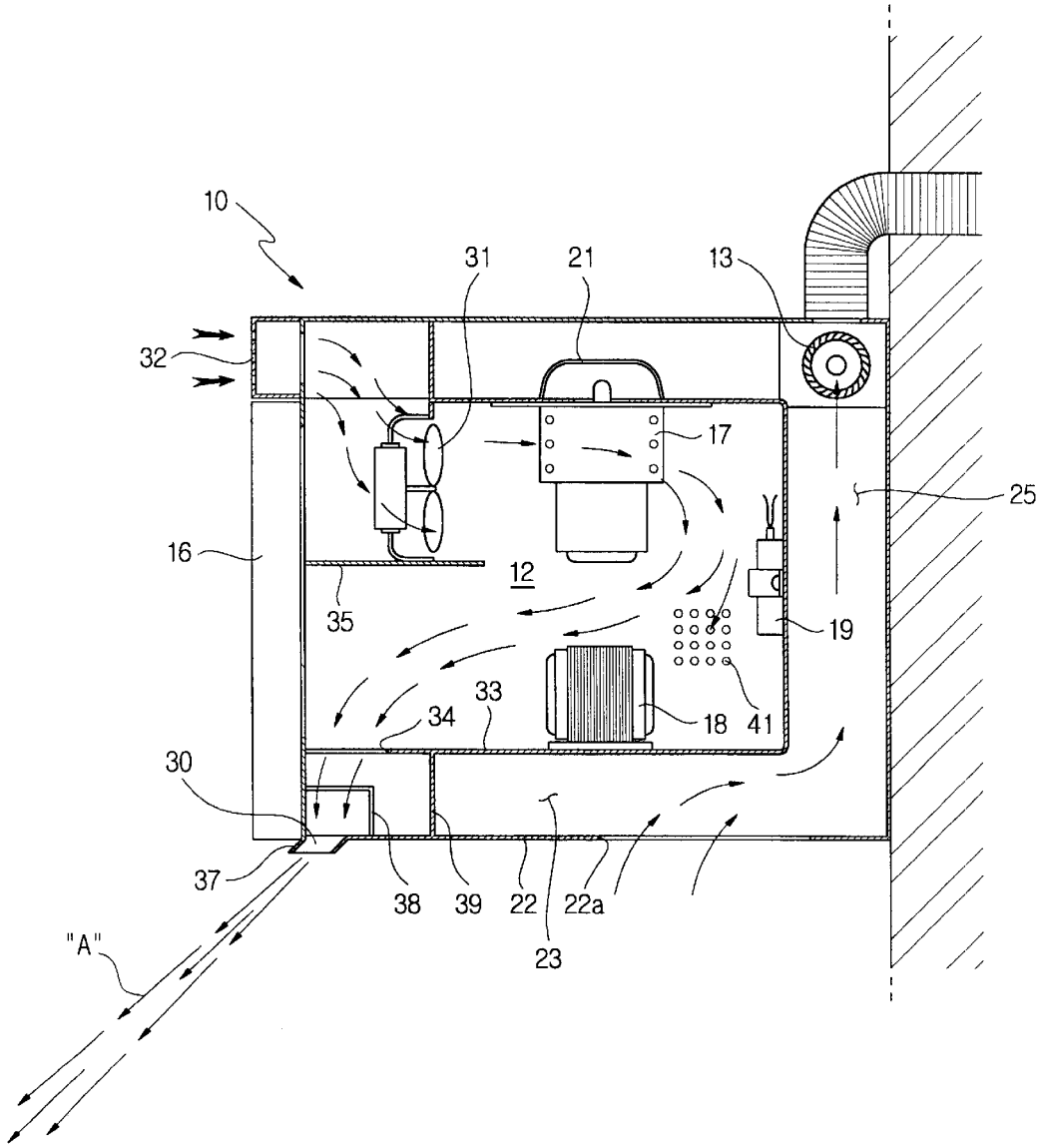
FIG. 5 is a side cross-sectional enlarged view of an electric component compartment of the wall-mounted microwave oven shown in FIGS. 2–4.

As shown in FIGS. 3 to 5, the exhaust flow path, which is adapted to exhaust the gas and fumes generated from the gas oven 100 positioned below the oven body 10, comprises an intake port 22*a* formed at a bottom plate 22 of the oven body 10 to allow the exhaust gas and fumes to pass therethrough, a lower flow path 23 defined between bottom surfaces of the cooking chamber 11 and the electric component compartment 12, and the bottom plate 22 of the oven body 10, rising flow paths 24 and 25 disposed at a side of the cooking chamber 11 and at a backside of the electric component compartment 12 to extend up and down, and an upper flow path 26 disposed on the oven body 10 to guide the gas and fumes introduced through the rising flow paths 24 and 25 toward the exhaust fan 13. As the exhaust fan 13 rotates, the gas and fumes sucked through the intake port 22*a* of the bottom plate 22 are exhausted to the outside through the lower flow path 23, the rising flow paths 24 and 25, and the upper flow path 26.

Additionally, the wall-mounted microwave oven guides the gas and fumes generated from the gas oven 100 toward the intake port 22*a* of the oven body 10 by using an air curtain "A" formed by air emitted from a front and lower portion of the oven body 10. That is, the oven body 10 is provided at its front and lower portion with an air-discharging outlet 30 which emits the air to form the air curtain "A." A blower fan 31 is provided in the electric component compartment 12 of the oven body 10, and draws in and forcibly blows the air toward the air-discharging outlet 30.

An air inlet 32 is provided on a front surface of an upper portion (above the control panel 20) of the electric component compartment 12. The air inlet 32 allows the air to be sucked into the electric component compartment 12 as the blower fan 31 disposed in the electric component compartment 12 is driven. A through hole 34 is formed at a bottom surface 33 of the electric component compartment 12, and enables an internal space of the electric component compartment 12 to communicate with the air-discharging outlet 30 so as to have the air introduced into the electric component compartment 12 flow toward the air-discharging outlet 30.

An air guide plate 35 is provided in the electric component compartment 12 and divides a front space of the electric component compartment 12 into upper and lower spaces so as to have the air introduced through the air inlet 32 flow toward the air-discharging outlet 30 via the through hole 34 while cooling the inside of the electric component compartment 12. The blower fan 31 is disposed on the air guide plate 35 and orient ed in the upper space of the electric component compartment 12 so as to direct the air blown from the blower fan 31 toward a rear side of the electric component compartment 12. Although the blower fan 31 is designed to cool the inside of the electric component compartment 12 and blow the air to form the air curtain "A," the electric component compartment 12 may be provided with two discrete blower fans, one of which is to form the air curtain "A," and the other of which is to cool the electric component compartment 12.

Figure 6:
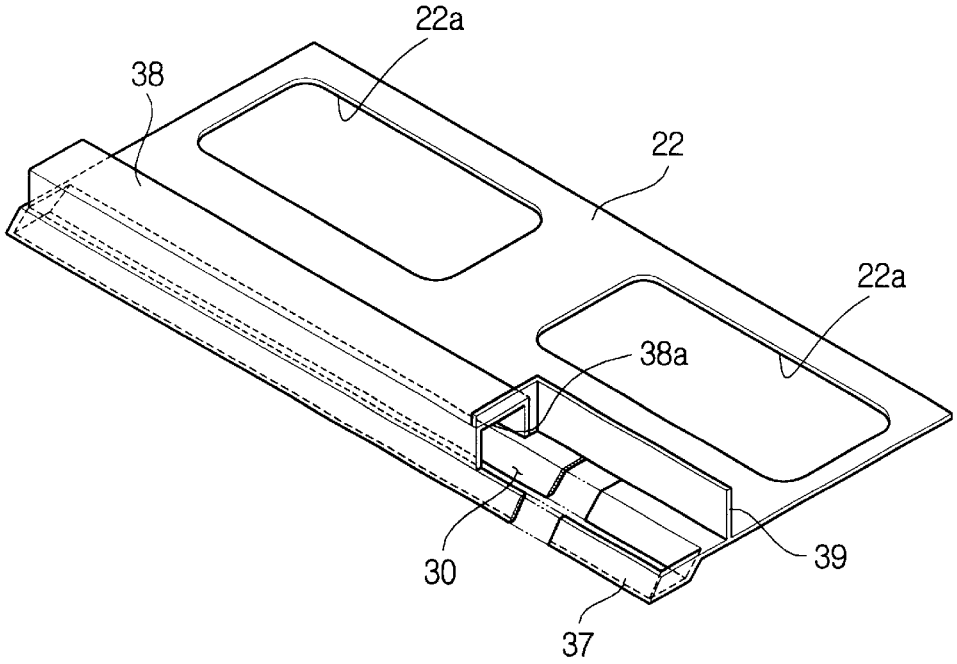
FIG. 6 is a perspective view of a bottom plate of the wall-mounted microwave oven shown in FIGS. 2–5.

FIG. 6 shows that the air-discharging outlet 30, which is provided at the front and lower portion of the oven body 10, is laterally formed at the bottom plate 22 of the oven body 10 so as to have its width be approximately equal to a width of the oven body 10. The air-discharging outlet 30 is also provided with an outlet guide 37 which extends in a direction of the discharged air (in an outward direction of the bottom plate 22) so as to direct the air emitted from the outlet duct 37 forward and downward.

The bottom plate 22 of the oven body 10 includes an air guide duct 38 which is disposed on the air-discharging outlet 30, and guides the air introduced via the through hole 34 toward the air-discharging outlet 30 disposed under the cooking chamber 11. The air guide duct 38 is sized to cover the air-discharging outlet 30 disposed under the cooking chamber 11, and is provided with an opening 38*a* at its end which is adjacent to the through hole 34. The bottom plate 22 is also provided thereon with a dividing plate 39, which is adapted to separate the air introduced from the electric component compartment 12 from the gas flowing in the lower flow path 23 (see FIG. 5). As shown in FIG. 6, the bottom plate 22 may be provided with two intake parts 22*a*.

Referring back to FIGS. 3 and 4, a partition plate 40, which is located between the electric component compartment 12 and the cooking chamber 11, is formed with a plurality of vent holes 41, so as to have the air circulated in the electric component compartment 12 by the blower fan 31 be partially introduced into the cooking chamber 11 to ventilate the cooking chamber 11. The cooking chamber 11 is formed with a plurality of vent holes 42 at its upper surface, opposite to the partition plate 40, and allows the air in the cooking chamber 11 to be discharged therethrough. A venting outlet 43 is provided to the cooking chamber 11 so as to allow the air, which has flowed out through the vent holes 42, to be discharged to the outside. A major part of the air circulated in the electric component compartment 12, except for the air introduced into the cooking chamber 11, flows toward the air-discharging outlet 30 through the electric component compartment 12.

With reference to FIGS. 2–5, an operation of the wall-mounted microwave oven according to the present invention will be described below.

In a cooking operation of the wall-mounted microwave oven, high-frequency electromagnetic waves generated from the magnetron 17, which is disposed in the electric component compartment 12, are emitted inside the cooking chamber 11 through the waveguide 21 to cook food received in the cooking chamber 11. At this point, as shown in FIG. 4, a ventilation of the cooking chamber 11 is carried out so as to have air, which is introduced in the electric component compartment 12 by the blower fan 31 disposed therein, be partially introduced into the cooking chamber 11. More specifically, the air circulated in the electric component compartment 12 is partially introduced into the cooking chamber 11 through vent holes 41 of the partition plate 40, and air containing moisture vapor in the cooking chamber 11 is discharged outside through the vent holes 42 formed on the upper surface of the cooking chamber 11 and the venting outlet 43, thus achieving ventilation of the cooking chamber 11. In addition to ventilating the cooking chamber 11, electric components housed in the electric component compartment 12 are cooled by the air introduced therein.

To exhaust gas and fumes generated from the gas oven 100 disposed below the oven body 10 during the cooking operation, an exhaust button (not shown) provided on the control panel 20 may be pressed by a user to activate the exhaust fan 13 installed at the rear and upper portion of the oven body 10. By activating the exhaust fan 13, the gas and fumes generated from the gas oven 100 are exhausted to the outside through the exhaust flow path. More specifically, upon activation of the exhaust fan 13, the gas and fumes generated from the gas oven 100 are introduced into the lower flow path 23 through the intake ports 22*a* formed at the bottom plate 22 of the oven body 10, and the gas and fumes introduced into the lower flow path 23 are raised through both of the rising flow paths 24 and 25 provided at the side and the backside of the cooking chamber 11 and the electric component compartment 12, respectively. Subsequently, the gas and fumes are drawn to the exhaust fan 13 through the upper flow path 26, and then exhausted to the outside from the exhaust fan 13.

Additionally, the blower fan 31 in the electric component compartment 12 is activated to form the air curtain "A" below the oven body 10 during the exhausting operation, as shown in FIGS. 2 and 5. In other words, by activating the blower fan 31, air introduced through the air inlet 32, which is provided at the upper side of the electric component compartment 12, is introduced into the electric component compartment 12 to cool the electric component compartment 12. Furthermore, the air is discharged from the-air-discharging outlet 30, which is provided at the front and lower portion of the oven body 10, to form the air curtain "A." That is, the air guide plate 35 in the electric component compartment 12 causes the air introduced into the compartment 12 through the air inlet 32 to first pass through the inside of the electric component compartment 12 to cool the electric components in the electric component compartment 12. Furthermore, the air guide duct 38 of the bottom plate 22 allows the air introduced via the through hole 34 to be evenly distributed throughout the air-discharging outlet 30 and be discharged therefrom.

As shown in FIG. 2, the air curtain "A" projected from the air-discharging outlet 30 is obliquely extended forward and downward to define a boundary between outside room air and the gas and fumes generated from the gas oven 100. The air curtain "A" prevents the gas and fumes generated from the gas oven 100 from being diffused into the outside room air (i.e., air in a kitchen space), and also directs the gas and fumes to the intake ports 22*a* of the oven body 10. Accordingly, the gas and fumes are discharged to the outside, and the room air is prevented from being contaminated by the gas and fumes. In particular, the air curtain "A" guides gas and fumes generated from a front burning section 110 of the gas oven 100, as well as those generated from a rear burning section, toward the intake ports 22*a* provided at the bottom plate 22 of the oven body 10.

As described above, the present invention provides a wall-mounted microwave oven which projects an air curtain forward and downward to guide gas and fumes, which are generated from a gas oven disposed below the wall-mounted microwave oven, toward an intake port of the wall-mounted microwave oven. Since the gas and fumes are effectively discharged to the outside, room air is not contaminated by the gas and fumes generated from the gas oven.

Furthermore, since a fan provided in the wall-mounted microwave oven cools an electric component compartment as well as forms the air curtain, the wall-mounted microwave oven of the present invention is also cost effective.

Although the present invention is described with respect to a wall-mounted/wallmountable microwave oven, it is understood that the present invention can be applied to other cooking apparatuses which are situated to vent gas and/or fumes generated by another cooking apparatus(es). That is, the present invention can be applied to, for example, a toaster oven, a convection oven, and a multiple heat source cooking apparatus, such as a dual microwave/convection oven, which also vents gas and/or fumes generated by another cooking apparatus(es).

Furthermore, an air-discharging outlet of the present invention can be designed so as to output an air curtain having a shape/an edge shape which includes at least one line, an arc, a semicircle, and a circle according to a selection in a control panel. In addition, the air-discharging outlet can be further designed so as to direct the air curtain to a specific burning section of a cooking apparatus.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wall-mounted microwave oven mountable on a wall above a range-oven, comprising:

a partition plate;

an oven body which is mountable on the wall and includes a cooking chamber and an electric component compartment which are isolated from each other by the partition plate;

an exhaust flow path disposed in the oven body to exhaust gas and fumes generated from the range-oven;

an exhaust fan which exhausts the gas and fumes introduced into the exhaust flow path to the outside;

an air-discharging outlet which is provided at a front and lower portion of the oven body, and forms an air curtain that guides the gas and fumes generated from the range-oven toward the exhaust flow path; and a blower fan which is disposed in the oven body and blows air to the air-discharging outlet.

2. The wall-mounted microwave oven as set forth in claim 1, wherein the blower fan is disposed in the electric component compartment so as to direct the air to the air-discharging outlet while cooling an inside of the electric component compartment.

3. The wall-mounted microwave oven as set forth in claim 2, wherein:

the air-discharging outlet laterally extends at a front and lower side of the oven body, and the oven body further includes a bottom plate having an air guide duct which forms a flow path to guide the air directed from the electric component compartment toward the air-discharging outlet.

4. The wall-mounted microwave oven as set forth in claim 2, wherein the oven body further includes an air inlet which is provided at an upper front face portion of the oven body, and through which the air is introduced into the electric component compartment by activation of the blower fan.

5. The wall-mounted microwave oven as set forth in claim 4, wherein:

the electric component compartment includes an air guide plate which divides a front space of the electric component compartment, adjacent to the air inlet, into upper and lower subspaces so as to circulate the air introduced through the air inlet in the inside of the electric component compartment and guide the air to the air-discharging outlet, and the blower fan is disposed in the upper subspace above the air guide plate.

6. The wall-mounted microwave oven as set forth in claim 2, wherein the partition plate, which defines a boundary between the cooking chamber and the electric component compartment, includes one or more vent holes which allow the air being circulated in the electric component compartment to be partially introduced into the cooking chamber therethrough.

7. The wall-mounted microwave oven as set forth in claim 1, wherein:

the air-discharging outlet laterally extends at a front and lower side of the oven body, and the oven body further includes a bottom plate having an air guide duct which forms a flow path to guide the air directed from the electric component compartment toward the air-discharging outlet.

8. The wall-mounted microwave oven as set forth in claim 1, wherein the air-discharging outlet comprises an outlet guide which extends forwardly and downwardly by a set length, and guides the air discharged from the air-discharging outlet forward and downward.

9. A wall-mountable microwave oven comprising:

an oven body having an exhaust path to exhaust gas and/or fumes existing below the oven body;

an air-discharging outlet which is provided at a front and lower portion of the oven body and forms an air curtain, wherein the air curtain guides the gas and/or fumes to the exhaust path; and a blower fan which sucks and blows air toward the air-discharging outlet.

10. The wall-mountable microwave oven as set forth in claim 9, wherein the air curtain is formed by the air channeled and projected from the air-discharging outlet.

11. The wall-mountable microwave oven as set forth in claim 9, further comprising:

a magnetron which generates high-frequency electromagnetic waves to cook food;

a high-voltage transformer which applies a voltage to the magnetron;

a cooking chamber having a turntable to place the food thereon;

a drive motor which rotates the turntable; and a wave guide which guides the high-frequency electromagnetic waves generated from the magnetron to the cooking chamber.

12. The wall-mountable microwave oven as set forth in claim 9, wherein the exhaust path comprises:

an intake port which is formed at a bottom plate of the oven body, and allows the gas and/or fumes to pass therethrough;

a lower flow path which defines a space above the bottom plate and the intake port;

rising flow paths which are disposed to corresponding sides of the oven body and connected to the lower flow path; and an upper flow path which is connected to the rising flow paths and communicates with the outside to exhaust the gas and/or fumes.

13. The wall-mountable microwave oven as set forth in claim 9, wherein:

the oven body further includes a cooking chamber and an electric component compartment having a through hole which communicates with the air-discharging outlet, and the blower fan is arranged in the electric component compartment, and simultaneously cools the electric component compartment while blowing the air toward the air-discharge outlet through the through hole.

14. The wall-mountable microwave oven as set forth in claim 13, wherein the air-discharging outlet comprises:

an outlet guide which projects the air to form the air curtain;

an air guide duct which guides the air introduced through the through hole toward the outlet guide, and a dividing plate which is arranged corresponding to the through hole, and separates the air introduced from the electric component compartment from the gas and/or fumes flowing to the exhaust path.

15. The wall-mountable microwave oven as set forth in claim 14, wherein the electric component compartment includes vent holes which communicate with the cooking chamber, so as to vent the cooking chamber using a portion of the air directed to the air-discharging outlet.

16. The cooking apparatus as set forth in claim 9, wherein the air curtain is projected in an obliquely angle from the oven body.

17. A cooking apparatus comprising:

a body having a cooking chamber to contain food therein, and an exhaust path to exhaust gas and/or fumes existing below the outer body;

a heating unit to cook the food;

an air-discharging outlet which forms an air curtain; and a blower fan which projects air toward the air-discharging outlet, wherein the air curtain guides the gas and/or fumes to the exhaust path of the body.

18. The cooking apparatus as set forth in claim 17, wherein the blower fan simultaneously cools the heating unit and projects the air toward the air-discharging outlet.

19. The cooking apparatus as set forth in claim 17, wherein the air curtain is a stream of air formed by the air projected from the air-discharging outlet.

20. The cooking apparatus as set forth in claim 17, wherein the cooking apparatus is a wall-mountable microwave oven.

21. The cooking apparatus as set forth in claim 17, further comprising a control panel which controls a cooking operation of the cooking apparatus, wherein the air-discharging outlet selectively forms the air curtain according to a control signal of the control panel.

22. The cooking apparatus as set forth in claim 21, wherein the air-discharging outlet forms the air curtain having at least one edge shape, which includes at least one line, an arc, a semicircle, and a circle according to a selection in the control panel.

23. The cooking apparatus as set forth in claim 21, wherein the air-discharging outlet selectively directs the air curtain to a desired area according to a selection in the control panel.

24. The cooking apparatus as set forth in claim 17, wherein the air-discharging outlet is moveably provided to the body so as to change a position of the air curtain.

25. The cooking apparatus as set forth in claim 17, wherein the air curtain is projected in an obliquely angle from the body of the cooking apparatus.

* * * * *